US007616162B2

(12) United States Patent
Hoffmeister

(10) Patent No.: US 7,616,162 B2
(45) Date of Patent: Nov. 10, 2009

(54) WINDOW-INTEGRATED ANTENNA IN A VEHICLE

(75) Inventor: Markus Hoffmeister, Salzgitter (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/577,905

(22) PCT Filed: Sep. 15, 2004

(86) PCT No.: PCT/EP2004/052188

§ 371 (c)(1),
(2), (4) Date: Sep. 30, 2008

(87) PCT Pub. No.: WO2005/043672

PCT Pub. Date: May 12, 2005

(65) Prior Publication Data

US 2009/0015493 A1 Jan. 15, 2009

(30) Foreign Application Priority Data

Oct. 30, 2003 (DE) ..... 103 50 780

(51) Int. Cl.
*H01Q 1/32* (2006.01)

(52) U.S. Cl. ..... 343/713; 343/711

(58) Field of Classification Search ..... None
See application file for complete search history.

(56) References Cited

U.S. PATENT DOCUMENTS

| | | | | |
|---|---|---|---|---|
| 5,877,727 | A * | 3/1999 | Saitou et al. | 343/713 |
| 6,201,505 | B1 * | 3/2001 | Terashima et al. | 343/713 |
| 6,229,493 | B1 * | 5/2001 | Iijima | 343/713 |
| 6,307,516 | B1 | 10/2001 | Schaefer et al. | |
| 6,396,445 | B1 * | 5/2002 | Saitoh et al. | 343/713 |

FOREIGN PATENT DOCUMENTS

| | | |
|---|---|---|
| EP | 0 382 895 | 8/1990 |
| EP | 0 751 580 | 1/1997 |
| EP | 1 315 232 | 5/2003 |
| JP | 9-018222 | 1/1997 |

* cited by examiner

*Primary Examiner*—Trinh V Dinh
(74) *Attorney, Agent, or Firm*—Kenyon & Kenyon LLP

(57) ABSTRACT

In a window-integrated antenna in a vehicle, conductor configurations are provided for FM ($L_{FM}$) reception as well as for AM ($L_{AM}$) reception which are separated with respect to RF from the heating circuit (B) via decoupling and matching circuits (EA1, EA2). The second decoupling and matching circuit (EA2) in the AM circuit is situated downstream from the first decoupling and matching circuit (EA1) in the FM circuit and in particular in the shunt circuit of the same. This makes it possible to utilize the FM structures as a supply lead to the AM structure. The filter expense of the second decoupling and matching circuit may be minimized.

15 Claims, 2 Drawing Sheets

WINDOW-INTEGRATED ANTENNA IN A VEHICLE

FIELD OF THE INVENTION

The present invention is directed to a window-integrated antenna in a vehicle.

BACKGROUND INFORMATION

Such a window-integrated antenna in a vehicle is known from European Published Patent Application No. 0 382 895. Antenna structures, which are separated from one another for FM reception and AM reception and are heated separately, are provided in EP 0382895 B1. Each of the structures has a matching and decoupling circuit. The vehicle window may be heated over its entire surface in this implementation; however, optimum reception of the signals in the AM and FM ranges is still possible.

SUMMARY OF THE INVENTION

The FM structures may be utilized as a supply lead to the AM structure. Since the second decoupling and matching circuit is situated downstream from the first decoupling and matching circuit, the power supply of the heating conductors of the AM circuit does not directly access the vehicle's power supply, but rather accesses the power supply for the FM circuit which has already run through the first decoupling and matching structure. Since the first decoupling and matching circuit already suppresses the better part of the interferences present in the power supply, the expense for circuitry, in particular the filter expense, for the second decoupling and matching circuit may be minimized.

By splitting the second decoupling and matching circuit in two, the filter expense per individual unit may be further reduced. This implementation of the assembly is equivalent to an implementation with a non-heated AM structure and is thus very easy to handle during the manufacturing process of the vehicle.

If the second decoupling and matching circuit is situated in a shunt circuit of the first decoupling and matching circuit, it is supplied with a lower direct current than the first decoupling and matching circuit. This makes it possible to dimension the decoupling means (blocking circuits) of the second decoupling and matching circuit for a lower direct current.

DETAILED DESCRIPTION

Figure 1:
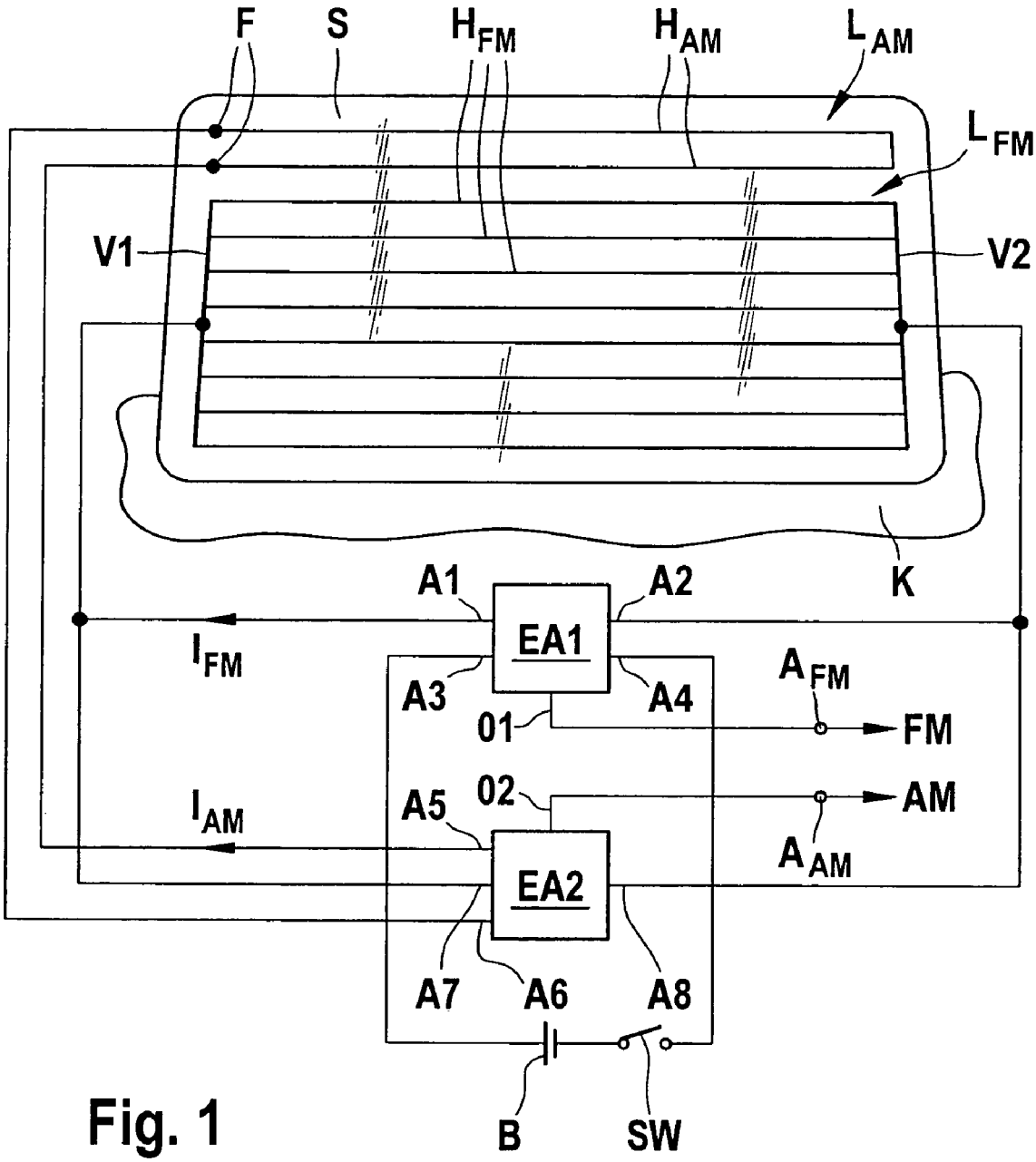
FIG. 1 shows a block diagram of a vehicle's window-integrated antenna according to the present invention.

In FIG. 1, which shows a block diagram of the window-integrated antenna in a vehicle including its decoupling and matching means, reference numeral S indicates a vehicle window which is installed in body shell K of the vehicle, the vehicle window being preferably the rear window of a motor vehicle. A first conductor configuration $L_{FM}$ made up of parallel heating conductors $H_{FM}$, which take up approximately ⅔ of the vehicle window's height, is situated in or on a vehicle window S. At their ends, the heating conductors are connected to one another via connecting conductors V1 and V2. Attached to connecting conductors V1 and V2 are terminals A1, A2 of a first decoupling and matching circuit EA1 whose additional terminals A3 and A4 are connected to the terminals of a direct current source B, which is preferably a vehicle battery. A switch SW is provided between direct current source B and terminal A4. An output 01 of first decoupling and matching circuit EA1 leads to a terminal $R_{FM}$ for FM signals. A second conductor configuration $L_{AM}$, which is spatially and electrically separated from first conductor configuration $L_{FM}$, is situated in or on vehicle window S preferably above the first conductor configuration; in the exemplary embodiment, second conductor configuration $L_{AM}$ is made up of two heating conductors $H_{AM}$ which are connected to one another at one end and form a heating loop. Two free ends F of second conductor configuration $L_{AM}$ at one side of rear window S are connected to terminals A5 and A6 of a second decoupling and matching circuit EA2. Two additional terminals A7 and A8 of second decoupling and matching circuit EA2 are connected to the supply leads of first decoupling and matching circuit EA1 to connecting conductors V1 and V2. An output 02 of the second decoupling and matching circuit leads to a terminal $A_{AM}$ for AM signals.

The above-described circuit functions as follows:

Decoupling and matching circuits EA1 and EA2 assigned to conductor configurations $L_{FM}$ and $L_{AM}$ have a structure known to those skilled in the art; see US-A 4 439 771, for example. When switch SW is closed, first conductor configuration $L_{FM}$ receives its heating current $I_{FM}$ from current source B via first decoupling and matching circuit EA1 and second conductor configuration $L_{AM}$ receives its heating current $I_{AM}$ via second decoupling and matching circuit EA2 downstream from first decoupling and matching circuit EA1 and situated in a shunt circuit of the same. On account of the fact alone that second decoupling and matching circuit EA1 is situated in the shunt circuit of first decoupling and matching circuit EA2, direct current $I_{AM}$ for second conductor configuration $L_{AM}$ is substantially lower than heating current $I_{FM}$ for first conductor configuration $L_{FM}$. This makes it possible to dimension the decoupling means of second decoupling and matching circuit EA2 for the lower heating current. The decoupling means in a known manner ensure that the RF voltages, induced in the conductor configurations, are not shorted via direct current source B. The signals of both the FM range and the AM range are available at terminals $A_{AM}$ and $A_{FM}$ of decoupling and matching circuits EA1 and EA2 for relaying to a car radio, for example.

In an alternative embodiment of the window-integrated antenna in a vehicle, heating conductors $H_{AM}$, $H_{FM}$ of both conductor configurations $L_{FM}$, $L_{AM}$ are connected at one end to the frame potential, preferably on the side facing connecting conductor V2.

Figure 2:
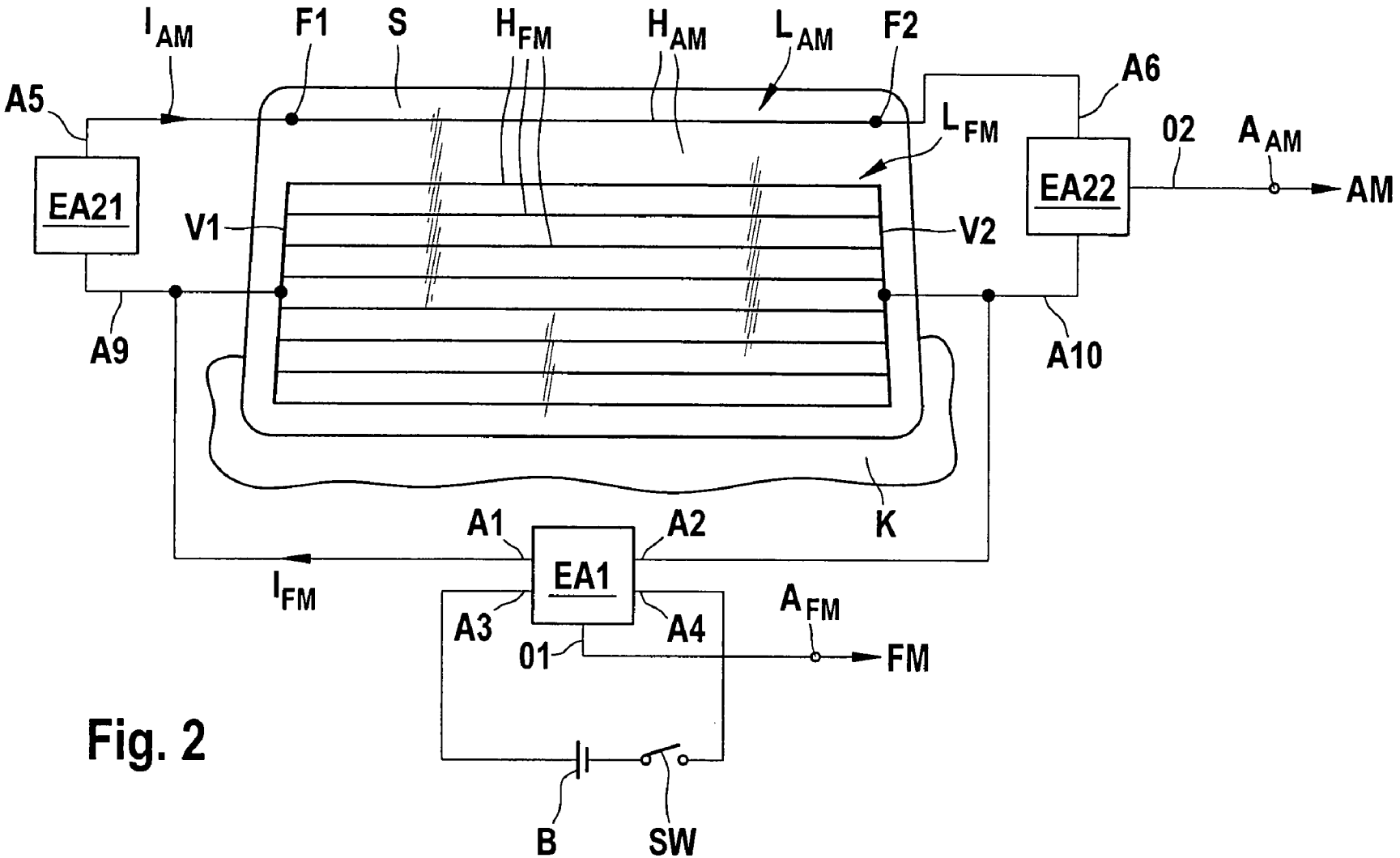
FIG. 2 shows an alternative embodiment including a split, second decoupling and matching circuit.

FIG. 2 shows an alternative embodiment of the window-integrated antenna in a vehicle including a split, second decoupling and matching circuit. The two sub-networks/filter structures, blocking circuits in particular, are indicated by EA21 and EA22. In this case, second conductor configuration $L_{AM}$ is made up of one or multiple unfolded printed conductors parallel to printed conductors $L_{FM}$. Their terminal ends F1, F2, at the sides of rear window S opposite to each other, each lead to a first terminal 5 or 6 of one of sub-networks/filter structures EA21 and EA22, whose second terminals A9 and A10 lead to connecting conductors V1 and V2. For coupling the AM signal, only one of the two filter structures is necessary, in this case EA22 including output terminal 02 and terminal $A_{AM}$.

What is claimed is:

1. A window-integrated antenna in a vehicle, comprising:

a first decoupling and matching circuit;

a first conductor configuration for FM reception and provided one of in and on a window of the vehicle, the first-conductor configuration including heating conductors supplied via the first decoupling and matching circuit;

a second conductor configuration for AM reception and spatially separated from the first conductor configuration; and a second decoupling and matching circuit via which heating conductors of the second conductor configuration are supplied, wherein the second decoupling and matching circuit is situated downstream from the first decoupling and matching circuit;

wherein the second decoupling and matching circuit is situated in a shunt circuit of the first decoupling and matching circuit, and in comparison to an overall heating current, the second decoupling and matching circuit is supplied with a lower direct current than the first decoupling and matching circuit.

2. The window-integrated antenna as recited in claim 1, wherein the second decoupling and matching circuit is split in two subsections.

3. The window-integrated antenna as recited in claim 2, wherein the subsections include two filter structures on the window, a rear window.

4. The window-integrated antenna as recited in claim 3, wherein the window includes a rear window.

5. The window-integrated antenna as recited in claim 3, wherein the second conductor configuration includes an unfolded printed conductor having terminal ends provided at sides of the window opposite to each other.

6. The window-integrated antenna as recited in claim 5, wherein the terminal ends of the unfolded printed conductor are each connected to one of the two filter structures.

7. The window-integrated antenna as recited in claim 3, wherein only one of the two filter structures is provided for coupling out an AM antenna signal.

8. The window-integrated antenna as recited in claim 1, wherein the heating conductors of the second conductor configuration form one of a heating conductor loop and multiple parallel heating conductor loops.

9. The window-integrated antenna as recited in claim 1, wherein:

the first conductor configuration takes up at least ⅔ of a height of the window, and the second conductor configuration, situated parallel to the first conductor configuration, takes up the rest of the height of the window.

10. The window-integrated antenna as recited in claim 1, wherein the heating conductors of the first conductor configuration and the second conductor configuration are connected at one side to a frame potential.

11. The window-integrated antenna as recited in claim 1, wherein the second decoupling and matching circuit includes two filter structures at both sides of the window.

12. The window-integrated antenna as recited in claim 11, wherein the window includes a rear window.

13. The window-integrated antenna as recited in claim 11, wherein the window includes a rear window.

14. The window-integrated antenna as recited in claim 1, wherein the second conductor configuration includes a conductor loop having terminal ends provided at one side of the window.

15. The window-integrated antenna as recited in claim 14, wherein the window includes a rear window.

* * * * *

UNITED STATES PATENT AND TRADEMARK OFFICE

CERTIFICATE OF CORRECTION

PATENT NO. : 7,616,162 B2
APPLICATION NO. : 10/577905
DATED : November 10, 2009
INVENTOR(S) : Markus Hoffmeister It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 107 days.

Signed and Sealed this

Nineteenth Day of October, 2010

David J. Kappos

David J. Kappos
*Director of the United States Patent and Trademark Office*